US005899356A

United States Patent [19]

Huisman

[11] Patent Number: 5,899,356

[45] Date of Patent: May 4, 1999

[54] EATING UTENSIL FOR HOLDING PIECES OF FOOD AND DISPENSER ASSEMBLY CONTAINING SUCH UTENSILS

[76] Inventor: Ronald Huisman, Koningslaan 65, Bussum, Netherlands, NL-1406 KG

[21] Appl. No.: 08/776,118

[22] PCT Filed: May 21, 1996

[86] PCT No.: PCT/EP96/02176

§ 371 Date: Mar. 27, 1997

§ 102(e) Date: Mar. 27, 1997

[87] PCT Pub. No.: WO96/37135

PCT Pub. Date: Nov. 28, 1996

[30] Foreign Application Priority Data

May 23, 1995 [DE] Germany ..... 295 08 539 U

[51] Int. Cl.[6] ..... B65H 1/00; A47J 43/28

[52] U.S. Cl. ..... 221/63; 221/61; 294/99.2

[58] Field of Search ..... 294/1.3, 3, 8.5, 294/11, 16, 33, 99.2; 221/33, 45, 61, 63

[56] References Cited

U.S. PATENT DOCUMENTS

| | | | |
|---|---|---|---|
| 838,662 | 12/1906 | Stephens | 294/99.2 |
| 1,605,496 | 11/1926 | Barbieri | 221/63 |
| 2,482,180 | 9/1949 | Heard | 294/99.2 |
| 2,570,167 | 10/1951 | Tobey | 221/63 |
| 3,138,211 | 6/1964 | Blom | 294/99.2 |
| 3,407,927 | 10/1968 | Jones | 294/1.3 |
| 4,511,039 | 4/1985 | Siemek | 294/99.2 |
| 4,550,856 | 11/1985 | Ballmann et al. | 221/63 |
| 4,707,922 | 11/1987 | Hosak-Robb | 294/99.2 |
| 5,709,423 | 1/1998 | Romero | 294/99.2 |

FOREIGN PATENT DOCUMENTS

| | | | |
|---|---|---|---|
| 376814 | 8/1907 | France | 294/99.2 |

*Primary Examiner*—Dean Kramer
*Attorney, Agent, or Firm*—Joseph W. Berenato, III

[57] ABSTRACT

An eating utensil is provided for holding pieces of food. The eating utensil is provided in the form of gripping tongs (1) with gripper arms (2–3) which can be moved towards each other against a restoring force from an open position into a gripping position. Also provided is a dispenser for the eating utensil. The dispenser holds a plurality of such eating utensils in a stacked relationship within the dispenser. A lowest one of the eating utensils in the dispenser is held in place by the combination of stop elements on the dispenser and catch devices on the utensils. While held in this manner, the lowest eating utensil protrudes partially from the dispensing shaft of the dispenser. The lowest eating utensil therefore can be pulled out of the dispenser for use. The next eating utensil, which was above the lowest eating utensil, then falls to the position of the lowest eating utensil. The combination of the eating utensil and the dispenser thus provides a convenient way of storing and dispensing eating utensils.

22 Claims, 2 Drawing Sheets

Figure 1:
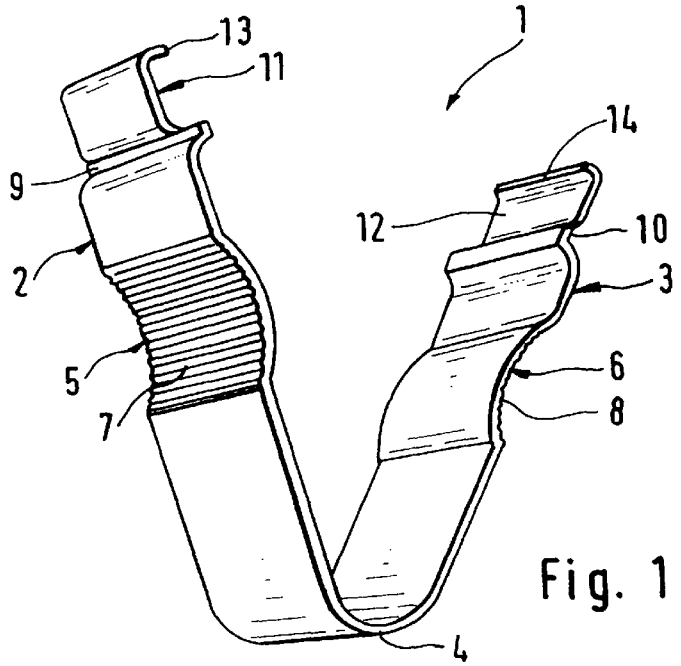

EATING UTENSIL FOR HOLDING PIECES OF FOOD AND DISPENSER ASSEMBLY CONTAINING SUCH UTENSILS

The invention relates to an eating utensil to be used for larger pieces of food, and a combination of a dispenser and the eating utensils held therein.

For the consumption of foods containing or consisting of larger-sized pieces, specifically fast-food dishes such as french fries, small sausages, etc. Eating utensils designed as two-pronged forks are generally provided, with which the food can be picked up and guided to the mouth. The disadvantage of these forks is that the food item can slide off and drop. There is also the risk of clothing and floors getting dirty.

The principal object of the invention is to design an eating utensil of the type described at the beginning, which can be used more securely to pick up larger-sized pieces of food. A further element of the object consists in designing the eating utensil so that it can easily be provided via self-service.

The first part of the object is attained in accordance with the invention in that the eating utensil is designed as a set of tongs having grips that can be pressed together, against a restoring force, from an opened position into a gripped position. Thus, in accordance with the invention, pieces of food are not picked up with a fork but are clamped by the grips. This results in a substantially improved grip on the piece of food by the eating utensil. Thus, it is more difficult to drop the food. Furthermore, the risk of soiling clothing and floors is reduced to a minimum. In addition, the eating utensil specified in the invention is characterized by its simple design, as it is sufficient to connect two gripping arms to one another via one connecting piece. This makes it possible to manufacture the tongs as a disposable product for single use, from inexpensive materials such as plastic. The tongs specified in the invention are particularly suited for use in the fast-food industry.

In the design of the invention, the connecting piece is designed as a bending joint. This expression should be understood to encompass every type of connector that would permit the gripping arms to move together against the pressure of a restoring force. Thus, the connecting piece may be designed, for example, as a simple connecting bow. In addition, or in combination with this, it is possible to form the gripping arms themselves to be flexible.

In a particularly preferred design, the tongs are designed so that a number of them can be stacked one inside the other in an opened position. This makes it advantageous for the tongs to be set open in a V-shape—preferably at an angle of approximately 60°. In addition, the tongs may be formed as a single component, from a single strip that is even in width and thickness.

In a further embodiment of the invention, it is provided that the tongs are preferably equipped on their outer surface with recessed grips that are lined with ridges, via which the gripping arms can be pressed together by the thumb and forefinger. The recessed grips should preferably be positioned halfway down the length of the tongs.

In a further embodiment of the invention, catchments are positioned on the open ends of the tongs on their outer surface. Such catchments are recommended particularly if the tongs are to be stored in dispensers and held there by means of complementary catch devices. This way, on the one hand, the tongs will not fall out of the dispenser, and on the other hand, they can be removed by lightly pressing the gripping arms together. These catch devices may, for example, be designed as grooves.

If the tongs are to be held in a dispenser, it is advantageous for the open ends of the gripping arms to be curved inward.

The second portion of the object is attained, in accordance with the invention, via a combination of a dispenser and the eating utensils stored therein. In accordance with the invention, this is characterized in that the dispenser contains a dispensing shaft that is preferably open toward the underside and is designed to hold a large number of tongs stacked one on top of another. The dispensing shaft and the tongs are designed to fit inside one another so that the tongs can slide downward by virtue of their own weight, or they can slide due to an additional force with stop elements provided in the lower end of the dispensing shaft; these stop elements will work in conjunction with the set of tongs that is in the lowest position. This way it is possible to pull these tongs out while preventing them from falling out.

In this embodiment, a large number of tongs stacked on top of one another can be provided for self-service use. The lowest set of tongs will be held in place by stop elements that can be removed.

After one set of tongs has been removed, the tongs that remain in the dispensing shaft slide down until the lowest set of tongs is moved into the region of the stop elements. It goes without saying that a dispenser of this type may also contain several such dispensing shafts, into which a large number of tongs are inserted and stacked on top of one another.

The stop elements are advantageously designed as catchments, located in the dispensing shaft and on the tongs. They fit into one another so that a portion of the lowest set of tongs protrudes from the dispensing shaft. The catchments may each be comprised of a protruding ridge and a groove into which this ridge fits. It is advantageous for the ridges to protrude in the dispensing shaft, and for the grooves to be formed in the outer surfaces of the tongs. This way, the stop elements on the side of the tongs should be positioned in the region of the open ends of the gripping arms.

The dispensing shaft is preferably rectangular having opposing long and short sides. In this case, the stop elements should be positioned in the short sides.

It is advantageous for the tongs to be positioned, under a certain amount of tension, on the opposing inner sides of the dispensing shaft. In order that they may be guided, the dispensing shaft should be equipped with opposing positioning grooves into which the open ends of the tongs catch.

Figure 3:
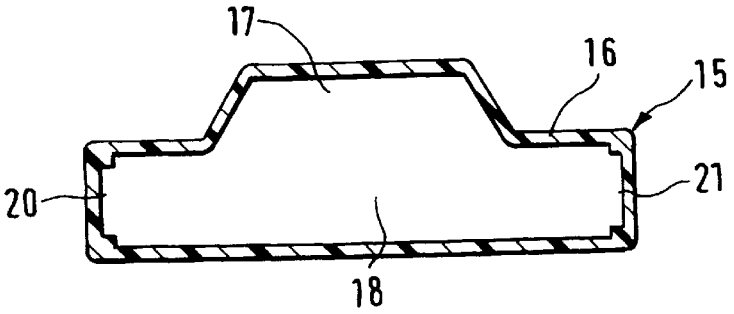
Figure 2:
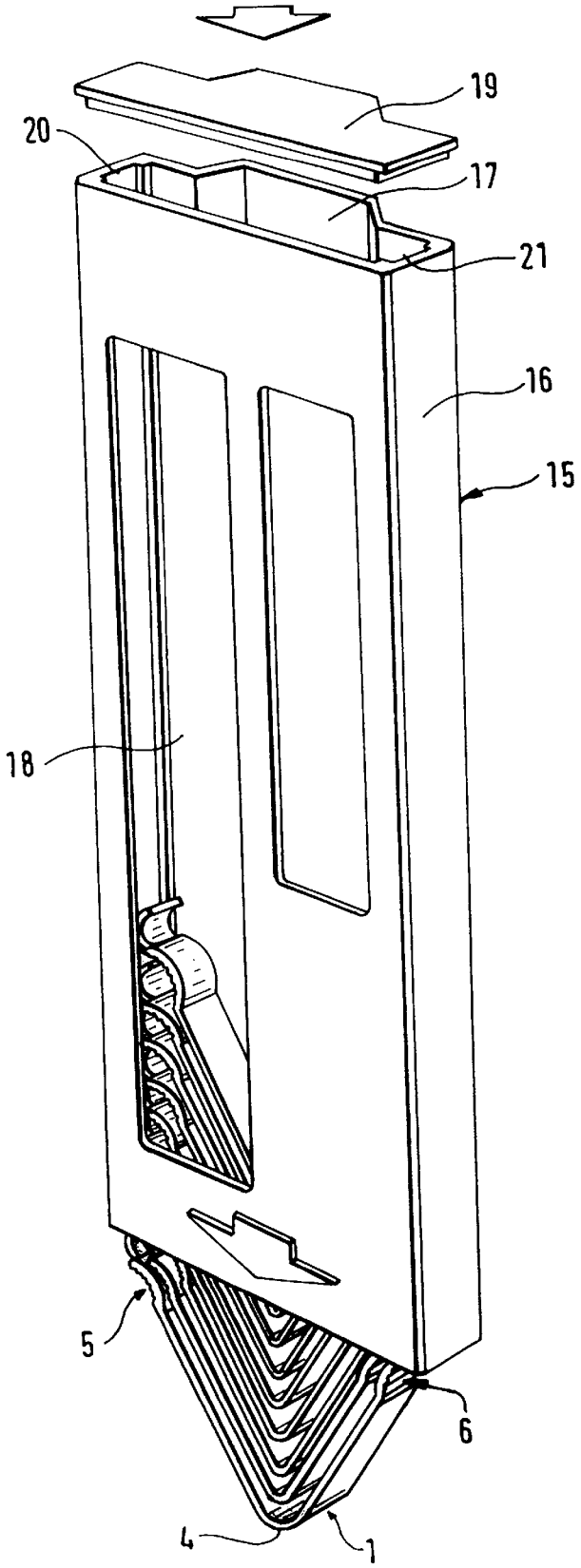

In the diagrams, the invention is illustrated in greater detail with the help of an exemplary embodiment. These show:

FIG. 1: A diagonal view of a set of tongs, in accordance with the invention;

FIG. 2: A combination of a dispenser and the tongs stacked therein, as shown in FIG. 1;

FIG. 3: A cross-section of the dispenser in accordance with FIG. 2; and

Figure 4:
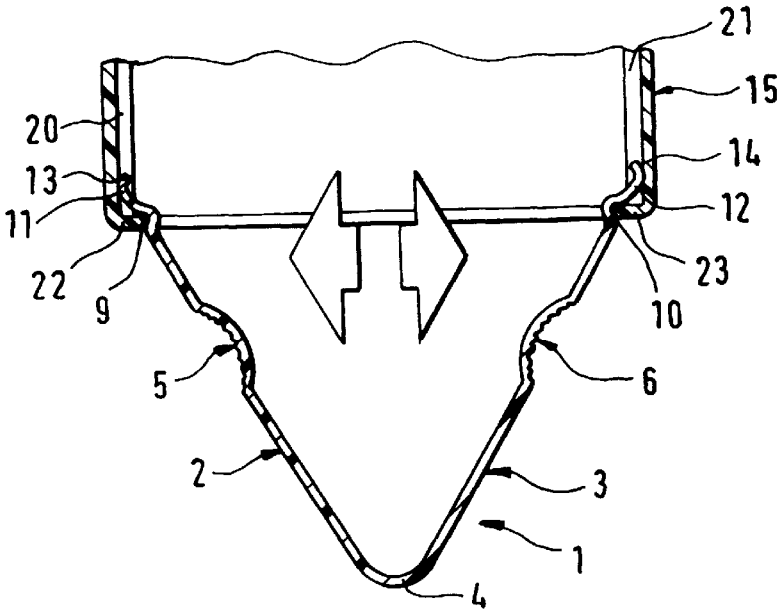

FIG. 4: a vertical section through the dispenser, with the lowest set of tongs as shown in FIG. 2.

The set of tongs shown in FIG. 1 is comprised principally of two gripping arms 2, 3, which diverge from one another in a V-shape, and of an arc-shaped connecting joint 4. The arc-shaped connecting joint 4 forms a type of flexible joint and holds the gripping arms 2, 3 in the position illustrated here when they are not being acted upon by any outside force. The arc-shaped connecting joint 4 permits the gripping arms 2, 3 to move together and separate, in each case against the effect of a flexible restoring force, the nature of which is to move the gripping arms 2, 3 back into the opened position illustrated here.

The set of tongs 1 is made from a strip of plastic that is even in width and thickness. The cross section and the stability of this plastic strip are structured so that it is possible to grip larger pieces of food between the gripping arms 2, 3, while there is sufficient flexibility for the gripping arms 2, 3 to be moved together from the opened position illustrated here into a gripping position.

The gripping arms 2, 3 are equipped, approximately halfway down their length—as seen from their outer surface—with concave recessed grips 5, 6, each of which is equipped with ridges 7, 8 for gripping with the thumb and forefinger the gripping arms 2, 3. On their open ends, the gripping arms 2, 3 are equipped with grooves 9, 10 which extend over the entire width of the arms, and each of which is open toward the outside surface. Connected to the grooves 9, 10 are gripping scoops 11, 12, which are intended primarily for picking up the pieces of food, with their open ends 13, 14 being curved inward.

FIGS. 2 and 3 show a dispenser 15. It is comprised of a basically rectangular housing 16 having an indentation 17 which is trapezoidal in its cross section and is located on the rear side, extending along the entire height of the housing 16. On the inside, the housing 16 is comprised of a dispensing shaft 18, the cross-section of which is illustrated in FIG. 2, and which is closed at its upper end by a cover 19, and is open at its lower end.

The dispensing shaft 18 corresponds approximately with the cross section of the housing 16. On its narrow sides it is equipped with positioning grooves that extend from the upper to the lower ends. The width of these grooves is designed to correspond with the width of the gripping scoops 11, 12 of the tongs 1 so that they fit into the positioning grooves 20, 21 and can slide along in these grooves.

As can be clearly seen in FIG. 2, a number of tongs—indicated here, for example, by the number 1—can be inserted into the dispensing shaft 18 so that each arc-shaped connecting joint 4 points downward and the gripping arms 2, 3 diverge symmetrically toward the top. They are stacked one inside the other, with the gripping scoops 11, 12 lying against the narrow sides of the dispensing shaft 18 in the positioning grooves 20, 21. The amount of tension present is such that the gripping scoops 11, 12 cannot pop out of the positioning grooves 20, 21. At the same time, the tongs 1 can easily slide downward in the dispensing shaft 18 by virtue of their own weight.

The tongs 1 are always prevented from falling out of the dispenser by the lowest set of tongs 1. This lowest set of tongs 1 is held in place via a catch device, which comprises ridges 22, 23 that protrude at the lower ends of the positioning grooves 20, 21, horizontally toward the inside (FIG. 4). These ridges 22, 23 become inserted in the catch grooves 9, 10, providing the lowest set of tongs 1 with enough hold that it cannot fall out because of the weight of the tongs 1 stacked on top of it. This is ensured by the tension force that presses in the direction indicated by the double arrows and is directed outward.

In order to permit the lowest set of tongs 1 to be removed, it is necessary only to press the gripping arms 2, 3 together enough that the engagement between the grooves 9, 10 and the ridges 22, 23 is lost, allowing the gripping scoops 11, 12 to glide past the ridges 22, 23. The removal of the lowest set of tongs 1 causes all the remaining tongs to slide downward. The set of tongs 1 that is next in line hangs in place by the ridges 22, 23 becoming inserted into the grooves 9, 10.

I claim:

1. A combination of a dispenser and eating utensils stored therein, wherein:

each eating utensil is intended for picking up larger bits of food, and is designed as a set of tongs having gripping arms that can be pressed together, against a certain restoring force, from an opened position into a gripping position; and the dispenser contains a dispensing shaft that is designed to hold a number of said tongs stacked one on top of the other, the dispensing shaft and the tongs being designed to complement one another, so that the tongs are slidable downward through the dispensing shaft, the dispensing shaft being equipped at a lower end thereof with stop elements which operate in conjunction with the lowest set of tongs so that it is possible to pull this lowest set of tongs out of the dispenser while preventing this lowest set of tongs from falling out on its own; the stop elements being designed to catch catch devices on the tongs, wherein the catch devices and stop elements complement one another so that one fits inside the other in a position in which the tongs protrude partially from the dispensing shaft.

2. The combination in accordance with claim 1, characterized in that the tongs are comprised principally of the gripping arms and a connecting piece that joins these two arms at one end.

3. The combination in accordance with claim 2, characterized in that the connecting piece is designed to function as a bending joint.

4. The combination in accordance with claim 3, characterized in that the connecting piece is designed as an arc-shaped connecting joint.

5. The combination in accordance with claim 1, characterized in that the gripping arms are flexible.

6. The combination in accordance with claim 1, characterized in that the tongs are designed so that several tongs may be stacked inside one another in an open position.

7. The combination in accordance with claim 1, characterized in that the gripping arms diverge in a V-shape.

8. The combination in accordance with claim 1, characterized in that the tongs are made from a single strip that is even in its width and thickness.

9. The combination in accordance with claim 1, characterized in that the gripping arms are equipped on their outer surface with recessed grips.

10. The combination in accordance with claim 9, characterized in that the recessed grips are positioned approximately halfway down the length of the gripping arms.

11. The combination in accordance with claim 1, characterized in that each of the gripping arms has an open end and the gripping arms are provided with said catch devices, positioned in the area of the open ends of the arms, on their outer surface.

12. The combination in accordance with claim 11, characterized in that the catch devices are designed as grooves.

13. The combination in accordance with claim 1, characterized in that the gripping arms have open ends which are curved inward.

14. The combination in accordance with claim 1, characterized in that the tongs are comprised of plastic.

15. The combination in accordance with claim 1, characterized in that each stop element is comprised of a protruding ridge, and each catch device is comprised of a groove into which the ridge fits.

16. The combination in accordance with claim 15, characterized in that each ridge projects into the dispensing shaft and each groove is formed in an outer surface of one of the gripping arms.

17. The combination in accordance with claim 16 characterized in that the gripping arms have open ends, and the stop elements that are on the side of the tongs are positioned in the area of the open ends of the gripping arms.

18. The combination in accordance with claim 1, characterized in that the dispensing shaft has opposing broad and narrow sides.

19. The combination in accordance with claim 18, characterized in that the stop elements are positioned on the narrow sides of the dispenser.

20. The combination in accordance with claim 1, characterized in that the gripping arms are laid, under a certain amount of tension, against the opposing inner sides of the dispensing shaft.

21. The combination according to claim 1, wherein said gripping arms diverge in a V-shape at an angle of approximately 60°.

22. A combination of a dispenser and eating utensils stored therein, wherein:

each eating utensil is intended for picking up larger bits of food, and is designed as a set of tongs having gripping arms that can be pressed together, against a certain restoring force, from an opened position into a gripping position;

the dispenser contains a dispensing shaft that is designed to hold a number of said tongs stacked one on top of the other, the dispensing shaft and the tongs being designed to complement one another, so that the tongs are slidable downward through the dispensing shaft, the dispensing shaft being equipped at a lower end thereof with stop elements which operate in conjunction with the lowest set of tongs so that it is possible to pull this lowest set of tongs out of the dispenser while preventing this lowest set of tongs from falling out on its own; and the gripping arms have open ends and the dispensing shaft is equipped with opposing positioning grooves into which the open ends of the gripping arms are placed.

* * * * *